US006481071B1

(12) United States Patent
Fehrer et al.

(10) Patent No.: US 6,481,071 B1
(45) Date of Patent: Nov. 19, 2002

(54) FACILITY FOR NEEDLING OF FLEECE

(75) Inventors: Monika Fehrer, Leonding (AT); Hannes Pum, Alberndorf (AT); Alois Öllinger, Leonding (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 357 days.

(21) Appl. No.: 09/587,988

(22) Filed: Jun. 6, 2000

(30) Foreign Application Priority Data

Jun. 18, 1999 (AT) ..... 1080/99

(51) Int. Cl.[7] ..... D04H 18/00
(52) U.S. Cl. ..... 28/107
(58) Field of Search ..... 28/107, 114, 115, 28/109, 108, 110, 111, 113; 112/80.4, 80.42, 80.44, 80.45

(56) References Cited

U.S. PATENT DOCUMENTS 3,798,717 A * 3/1974 Brochetti ..... 28/107
3,849,845 A * 11/1974 Obenaus ..... 28/107
3,877,121 A * 4/1975 Obenaus ..... 28/115
3,889,326 A * 6/1975 Tyas ..... 28/115
4,241,479 A * 12/1980 Dilo ..... 28/107
4,977,653 A * 12/1990 Pum ..... 28/111
5,153,970 A * 10/1992 Konig ..... 28/107
5,548,881 A * 8/1996 Ludwig ..... 28/114
5,568,678 A * 10/1996 Fehrer ..... 28/107
5,699,595 A * 12/1997 Feyerl ..... 28/107
5,873,152 A * 2/1999 Jourde et al. ..... 28/107
6,000,112 A * 12/1999 Ollinger et al. ..... 28/107
6,161,269 A * 12/2000 Dilo et al. ..... 28/107

FOREIGN PATENT DOCUMENTS

EP 0 786 027 7/1997
EP 0 892 102 5/1998

* cited by examiner

*Primary Examiner*—Amy B. Vanatta
(74) *Attorney, Agent, or Firm*—Collard & Roe P.C.

(57) ABSTRACT

The description refers to a facility for needling of fleece with a needle bar (6) taking up at least one needle board (1), which is driven to and fro via axially displaceable pushing rods (7, 8) by means of an eccentric drive (11). To facilitate a longer needle board in fleece feed direction, we suggest to fix the needle bar (1) at two rows of pushing rods (7, 8), arranged in tandem at some distance from each other in fleece feed direction and connected via a crosshead (9), and to make the eccentric drive (11) act upon the crosshead (9).

3 Claims, 2 Drawing Sheets

FACILITY FOR NEEDLING OF FLEECE

FIELD OF THE INVENTION

The invention refers to a facility for needling of fleece by means of a needle bar holding at least one needle board, which is driven to and fro by means of an eccentric drive via axially displaceable pushing rods.

DESCRIPTION OF THE PRIOR ART

Since the stitching density at a given lifting frequency of the needle bar of a needling facility depends on the number of needles of the inserted needle board on the one hand, and on the rate of feed of the fleece to be needled on the other hand, the rate of feed of the fleece and thus the performance of the needling facility can be increased at a given stitching density by increasing the number of needles arranged in tandem in fleece feed direction. However, an extension of the length of the needle boards measured in fleece feed direction is prevented by the fact that the needle bar is supported at two axially displaceable pushing rods driven to and fro by means of an eccentric drive. These pushing rods are arranged in a row transverse to fleece feed direction, so that off-center loads of the needle board relative to fleece feed direction lead to tilting moments of the needle bar along the connecting axis of the contact points between the pushing rods and the needle bar. As these tilting moments must be reduced to an acceptable level, there is a limitation regarding the needle board length in fleece feed direction. Therefore, the only way to improve the performance of the needling machine is to arrange two needling facilities with one needle board, each, arranged in tandem, which makes the construction more complicated. Moreover, in case of needling facilities intended for patterned surface structures of the fleece, the possible shape of patterns is limited by the length of the needle board in fleece feed direction, because these patterns depend on the board surface available for distributing the needles. However, this limitation with respect to pattern cannot be evaded by arrangement of a successive needle board.

For jointly driving two needle boards arranged behind each other in fleece feed direction, reciprocating both in stitching direction and in fleece feed direction, the approach has been made (EP 0 892 102 A2) to arrange the needle bars of the two needle boards on one common rest, which is borne via the connecting rods of two eccentric shafts circulating in opposite directions, in some kind of four-bar mechanism. However, this acknowledged construction demands two needle boards with one needle bar, each.

SUMMARY OF THE INVENTION

Therefore, it is the purpose of this invention to design a facility for needling of fleece as described above, in such a way that the length of the needle board can be considerably extended in fleece feed direction without putting up with unfavourable consequences regarding construction.

The invention solves this task by fixing the needle bar at two rows of pushing rods arranged in tandem at some distance in fleece feed direction and connected via a crosshead, with the eccentric drive acting upon the crosshead.

Since the needle bar is not fixed in the conventional way at one row of pushing rods, but at two rows of pushing rods arranged in tandem at some distance in fleece feed direction, the torques effective on the needle board can be carried off easily to the pushing rods via the needle beams, because, in case of torque load of the needleboard, the pushing rods arranged at some distance to each other both in fleece feed direction and transverse to it are mainly subject to tensile and compressive stress. Thus is it easily possible to more than double the extension of the board in fleece feed direction compared with similar needle boards, so that the measures provided by the invention permit one correspondingly longer needle board in fleece feed direction, instead of a tandem arrangement of two needling facilities, which offers all the benefits gained by an extension of the board in fleece feed direction. To this end the pushing rods must be moved synchronously, which is easily achieved by connecting the rows of pushing rods via a crosshead, where the eccentric drive is effective.

The crosshead may be connected rigidly with the pushing rods, so that the crosshead is guided via the pushing rods proper. There is another possible construction by bearing the crosshead displaceable, parallel to the pushing rods, with the pushing rods articulated at the crosshead, leading to a favorable allowance compensation.

BRIEF DESCRIPTION OF THE DRAWING

The drawing depicts an example of the subject matter of the invention.

DESCRIPTION OF THE PREFERRED EMBODIMENTS

Figure 1:
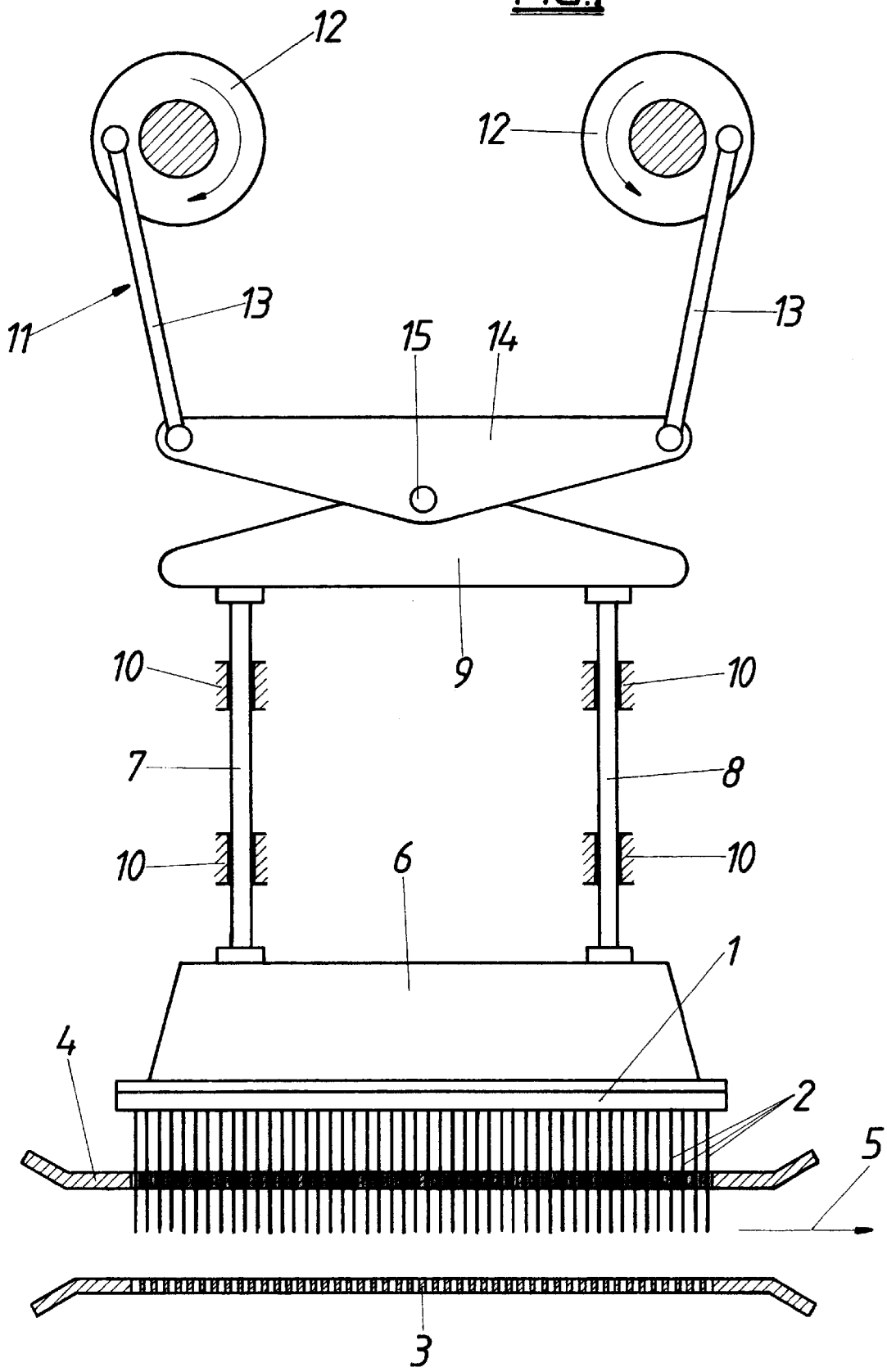
FIG. 1 shows a facility for needling of fleece according to the invention in a schematic and partly vertical section.

According to FIG. 1, the depicted facility for needling of fleece has one needle board 1 with needles 2, stitching into a fleece guided between a stitching base 3 and a shedder 4, which is fed through the facility in the direction of the arrow 5. The needle board 1 is clamped to a needle bar 6, fixed via two rows of pushing rods 7 and 8 arranged in pairs transverse to the fleece feed direction. These pushing rods 7 and 8 are connected via a crosshead 9, with a deflection-resistant connection of the pushing rods 7 and 8 to the crosshead 9. An eccentric drive 11, consisting of two eccentric shafts 12 circulating in opposite direction, the connecting rods 13 of which are connected via a coupler 14, serves for driving of the axially displaceable pushing rods 7 and 8 guided in sliding bearings 10. Since the coupler 14 is effective at the crosshead 9 via an articulated axis 15 of the pushing rods 7 and 8, the pushing rods 7 and 8 are moved to and fro in the sliding guides 10 by means of the eccentric drive 11, with the needles (2) stitching periodically into the fleece, which is conveyed in steps in fleece feed direction 5 via a continuous withdrawal unit during release by the needles 2.

Due to the two rows of pushing rods 7 and 8, generally consisting of two pushing rods 7 and/or 8 each, there is a favorable torque support of the needle bar 6, so that this kind of needle bar bearing permits the needle board 1 to be comparatively long in fleece feed direction 5. This means that the needle board 1 can be equipped with a larger number of needles 2, so that the performance of the needling facility can be improved by an increase of the rate of feed, without having to put up with drawbacks regarding stitching density. But the longer dimension of the needle board 1 in fleece feed direction 5 doesn't only imply an improved performance, but also permits a greater variety of patterns for surface structuring of the fleece, due to the larger board surface available for distributing the needles.

Figure 2:
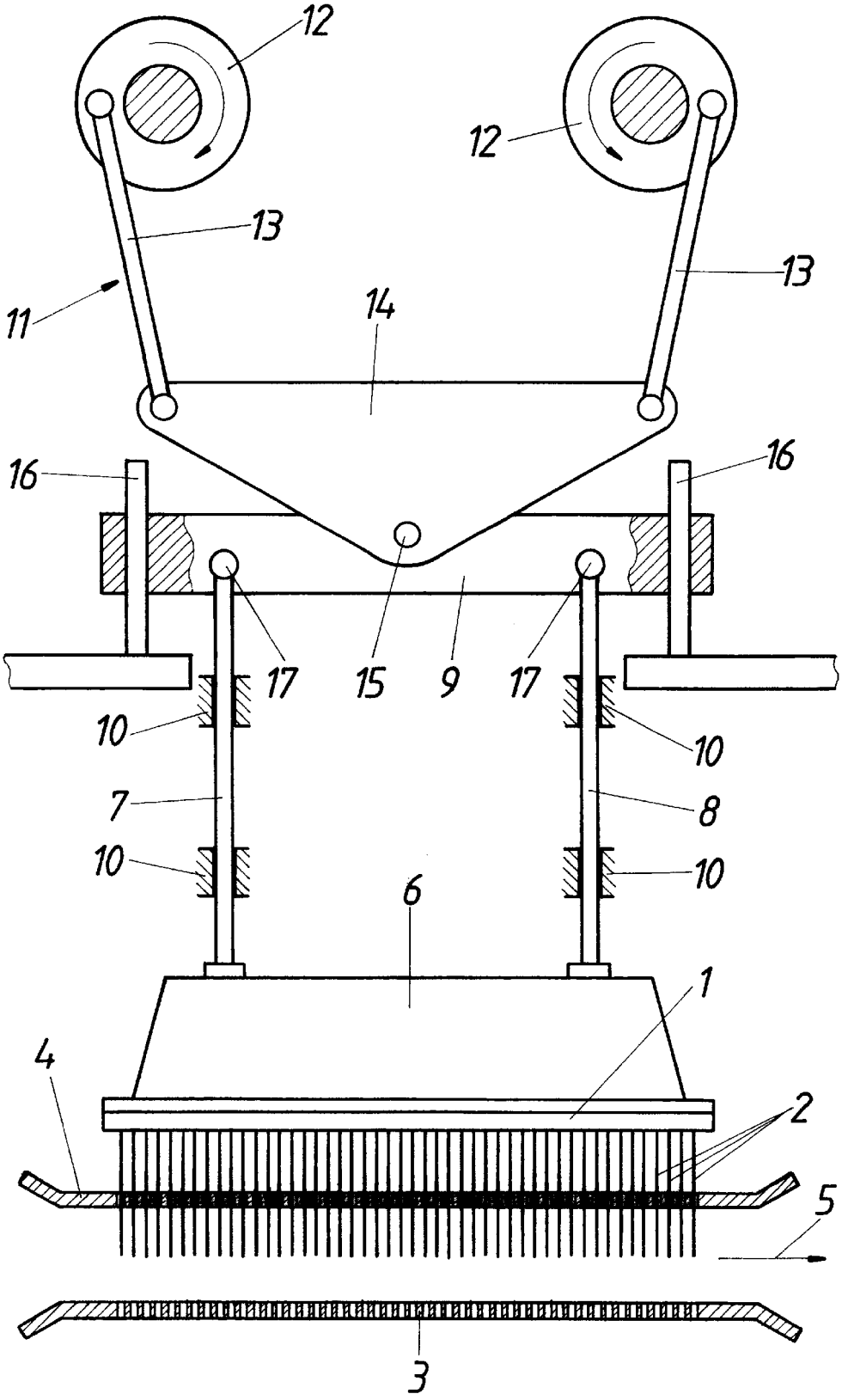
FIG. 2 represents another example of the construction, corresponding to FIG. 1.

The type of construction according to FIG. 2 differs from the construction according to FIG. 1 only in the kind of guiding of the crosshead 9 to the connection of the pushing rods 7 and 8. Since, according to FIG. 2, the crosshead 9 is borne displaceable on guiding rods 16, running parallel to the pushing rods 7 and 8, the pushing rods 7 and 8 can be articulated at the crosshead 9 via the axles 17, thus ensuring favorable guiding and bearing conditions, particularly since the transverse forces effective on crosshead 9 can be carried off immediately via the guiding rods 16.

What is claimed is:

1. Facility for needling of a fleece comprising:

a needle bar supporting at least one needle board, said needle bar being driven to and fro via axially displaceable pushing rods by means of an eccentric drive, wherein the needle bar is fixed to two of said pushing rods arranged in tandem at some distance in a fleece feed direction, said two pushing rods being connected to each other via a crosshead, and wherein the eccentric drive acts upon the crosshead.

2. Facility according to claim 1, wherein the crosshead (9) is connected rigidly with the pushing rods (7, 8).

3. Facility according to claim 1, wherein the crosshead (9) is borne displaceable parallel to the pushing rods (7, 8), and the pushing rods (7, 8) are articulated to the crosshead (9).

* * * * *